United States Patent [19]

Green et al.

[11] 4,425,243

[45] Jan. 10, 1984

[54] FOAMING AGENTS FOR USE IN DRILLING FOR OIL AND GAS

[75] Inventors: Harold A. Green, Havertown, Pa.; Morris Weinstein, Paramus; Kenneth W. Prodo, Westfield, both of N.J.

[73] Assignee: Millmaster Onyx Group, Inc., New York, N.Y.

[21] Appl. No.: 435,720

[22] Filed: Oct. 21, 1982

[51] Int. Cl.[3] ..... E21B 7/00; C09K 3/00; B01J 13/00; C11D 1/12

[52] U.S. Cl. ..... 252/8.5 C; 252/8.55 C; 252/307; 252/547; 564/297; 564/298; 175/69

[58] Field of Search ..... 252/8.5 C, 547, 307, 252/8.55 R, 8.55 C; 564/297, 298; 175/69

[56] References Cited

U.S. PATENT DOCUMENTS

| | | | |
|---|---|---|---|
| 2,169,976 | 8/1939 | Guenther | 252/357 |
| 3,111,998 | 11/1963 | Crowley | 252/8.5 C |
| 3,130,798 | 4/1964 | Schramm | 252/8.5 C |
| 3,223,186 | 12/1965 | Lummus | 252/8.5 C |
| 3,317,430 | 5/1967 | Priestley | 252/547 |
| 3,486,560 | 12/1969 | Hutchison | 252/8.5 C |
| 3,501,426 | 3/1970 | Yu | 564/297 X |
| 4,287,102 | 10/1981 | Miyajima | 252/547 |

*Primary Examiner*—Benjamin R. Padgett
*Assistant Examiner*—Catherine S. Kilby
*Attorney, Agent, or Firm*—Arthur A. Jacobs

[57] ABSTRACT

Foaming agents for use in oil and gas production comprising n-octyl dimethylamine oxide, n-decyl dimethylamine oxide, branched decyl dimethylamine oxide, and mixtures thereof, all of which generate copious quantities of stable foam even in the presence of brine and hydrocarbons.

3 Claims, No Drawings

FOAMING AGENTS FOR USE IN DRILLING FOR OIL AND GAS

This invention relates to surfactant foaming agents which generate circulating aqueous foams in oil and gas drilling, and it more particularly relates to the use of n-octyl dimethylamine oxide, n-decyl dimethylamine oxide, branched decyl dimethylamine oxide, or mixtures thereof, which generate copious quantities of very stable circulating foams when used in the process of rotary drilling for oil and gas, even in the presence of brine and hydrocarbon contaminants.

The use of circulating foams generated with the aid of surfactants during rotary air-drilling for gas and oil is a relatively recent development. In this respect, in addition to acting as drill lubricants and coolants, thereby extending the life of the drilling bit and reducing fluid loss, these circulating foams also act as clean-up agents by suspending the free cuttings and transporting them away from the drilling bit. Such foams also displace and circulate away from the bit the heavier formation liquids which might seep into the bore. The use of these foams, therefore, results in faster drill penetration and lower drilling costs.

The proficiency with which a foam suspends and transports cuttings and formation liquids depends, to a large extent, on foam texture. A thin watery foam, for example, will seldom suspend and transport the heavier materials, whereas a thick foam is more likely to do so. Foam texture, in turn, depends on bubble size, bubble size distribution and the ratio of air (or any other satisfactory gas) in the foam relative to the volume of the liquid phase which forms the thin film between air (or other gas) bubbles.

Not surprisingly, different surfactants produce foams of different textures, and since the requirements for foams to be useful in drilling are not easily attainable, only a limited number of surfactants are capable of generating foams that are suitable for air-drilling.

There are also certain practical considerations which may tend to limit even further the number of useful surfactants that are satisfactory for air or gas drilling. The most important of such considerations are:

1. The volume of foam generated by a given quantity of surfactant (which is related to the gas/liquid ratio), 2. The stability of the foam.

The volume of foam should be as large as possible lest the cost of using the surfactant become prohibitive. The foam should also be as stable as possible in order to prevent collapse of the foam column in the bore—which would necessitate the discontinuance of drilling until the column of foam is regenerated.

A very significant problem in the use of surfactants for oil and gas drilling is the presence of brine and hydrocarbons in the bore. The water which is pumped in from nearby areas or which seeps into the bore is most likely to be brackish, and it is well known that surfactants generate considerably less foam in saline water than in "soft" or "sweet" water. In addition, liquid hydrocarbons are notorious foam suppressants and destabilizers. Therefore, for a surfactant to be a satisfactory foam generator in oil and gas drilling, it should be able to maintain and sustain its foam generating properties in the presence of both brine and hydrocarbon contaminants.

The usual method of applying foam generating surfactants is to inject them into the drill bore. The mechanical agitation of rotary drilling and the large volume of air which is pumped into the bore supply the energy which causes the surfactant to generate foam. If additional water is required to dilute the surfactant that, too, is pumped into the bore.

In accordance with the present invention, it has been discovered that n-octyl dimethylamine oxide, n-decyl dimethylamine oxide and branched decyl dimethylamine oxide, either individually or in mixtures with each other, produce an ample supply of thick stable foam under mechanical agitation which is suitable for air-drilling use.

The fact that n-octyl dimethylamine oxide and n-decyl dimethylamine oxide are such good, stable foam producers is quite surprising inasmuch as amine oxides, as a general class, do not exhibit superior foaming properties. Indeed, n-hexyl dimethylamine oxide, n-dodecyl dimethylamine oxide and n-tridecyl dimethylamine oxide, the adjacent homologs in the series, displayed inferior foaming and stability properties in screening tests. Cyclic amine oxides were also found to be inferior in this respect. It was also surprisingly found that branched decyl dimethylamine oxide was effective for the present purposes since branching in the alkyl chain was believed to decrease both foaming and foam stability properties.

The branched decyl radical of the branched decyl dimethylamine oxide which was used for testing purposes was derived from "decyl alcohol" having a CAS number 68551-08-06*, supplied by both Exxon Chemical Co., and U.S. Steel. This product is actually a mixture of branched primary alcohols having 10 carbon atoms, the preponderant components of which are trimethyl heptanols. This mixture of primary alcohols is readily converted to a mixture of primary alkyl-chlorides with dry HCl gas. The alkyl chlorides, upon reaction with dimethylamine in the presence of a base, yield the branched decyl dimethylamines. These tertiary amines are then converted to amine oxides with hydrogen peroxide. All of these reactions are straightforward, and quite well known. Since the chemical transformations which convert the branched decyl alcohol to branched decyl dimethylamine oxide are mild, low energy reactions that practically preclude rearrangements, the branched decyl substituent of the amine oxide reflects the same branched radicals and same distribution of structures as is found in the starting mixture of branched decyl alcohols.

In view of the above, the term "branched decyl", as used herein, represents a mixture of primary branched ten-carbon alkyl groups with the same distribution of structures that is found in commercial "decyl" alcohol as described above, and does not represent the n-decyl radical, per se.

The following test procedure was used to evaluate and compare the various amine oxides and mixtures of amine oxides.

1. All mixing was performed in a Waring Blender, Model "Futura II".

2. A highly concentrated brine solution was prepared by dissolving 192 grams of NaCl and 62 grams of $CaCl_2$ in 2400 milliliters of distilled water. This concentration of salts was chosen because it is at least equal to the water-hardness found in any oil and gas producing areas.

3. Each surfactant that was evaluated was dissolved at the aforesaid brine solution to make a 1% active surfactant solution (weight of active surfactant to volume of brine solution).

4. Exactly 99.5 milliliters of 1% active surfactant solution was placed in the mixing container of a Waring Blender.

5. Exactly 0.5 milliliter of kerosene was added to the container.

6. The contents of the container were mixed at highest blender speed for exactly 60 seconds (using a stop watch), after which time practically all of the contents became foam for most mixtures.

7. The texture of the foam was noted.

8. The height of the foam column in the container was measured.

9. At the moment that mixing was stopped the stop watch was started again while the foam height was measured.

10. The aqueous liquid drained slowly down the column of foam and, as it drained, the liquid-foam interface rose. When the interface reached a previously marked 50 milliliter mark in the container, the stop watch was stopped, and the elapsed drainage time was recorded. This constituted a measure of the half-life of the foam.

The results of the test are tabulated below, where the abbreviation "DMAO" is used to designate dimethylamine oxide.

TABLE 1

| 99.5 Milliliters of 1% Solution, in Brine, + 0.5 Milliliters of Kerosene | Foam Height in Millimeters | Half-Life in Seconds |
|---|---|---|
| n-hexyl DMAO | 0 | 0 |
| | 0 | 0 |
| n-octyl DMAO | 65 | 175 |
| | 67 | 184 |
| n-decyl DMAO | 95 | 208 |
| | 90 | 202 |
| n-dodecyl DMAO | 45 | 118 |
| | 45 | 121 |
| n-tridecyl DMAO | 25 | 0 |
| | 25 | 0 |
| (n-octyl DMAO 50%) | 100 | 193 |
| (n-decyl DMAO 50%) | 98 | 197 |
| branched decyl DMAO | 60 | 158 |
| | 60 | 164 |
| (n-octyl DMAO 50%) | 60 | 153 |
| (branched decyl DMAO 50%) | 60 | 157 |
| (n-decyl DMAO 50%) | 90 | 198 |
| (branched decyl DMAO 50%) | 85 | 202 |
| (n-octyl DMAO 33%) | | |
| (n-decyl DMAO 33%) | 90 | 174 |
| (branched DMAO 33%) | 90 | 171 |

The preceeding table permits a comparison of the foaming properties of amine oxides in the presence of brine and organic matter. The table shows that n-octyl dimethylamine oxide, n-decyl dimethylamine oxide, and mixtures of these materials either with each other or together with the branched decyl dimethylamine oxide, have superior foaming properties in that they produce large quantities of thicker foam with longer half-life than would otherwise be expected.

In order to test the efficacy of the present compounds at higher hydrocarbon concentrations, the series of tests was repeated twice, wherein each series was similar in every respect to the first series except that the hydrocarbon concentrations were greater than 0.5%.

In one of these series the hydrocarbon concentration was 1.0%, the results being shown in Table 2. In the other series the hydrocarbon concentration was 2.0%, the results being shown in Table 3.

TABLE 2

| 99.0 Milliliters of 1% solution in Brine, + 1.0 Milliliter of Kerosene | Foam Height in Millimeters | Half-Life in Seconds |
|---|---|---|
| n-hexyl DMAO | 0 | 0 |
| n-octyl DMAO | 80 | 224 |
| n-decyl DMAO | 93 | 205 |
| n-dodecyl DMAO | 45 | 120 |
| n-tridecyl DMAO | 24 | 0 |
| (n-octyl DMAO 50%) | 97 | 195 |
| (n-decyl DMAO 50%) | | |
| branched decyl DMAO | 60 | 161 |
| (branched decyl DMAO 50%) | 60 | 155 |
| (n-octyl DMAO 50%) | | |
| (branched decyl DMAO 50%) | 80 | 200 |
| (n-decyl DMAO 50%) | | |
| (n-octyl DMAO 33%) | 90 | 173 |
| (n-decyl DMAO 33%) | | |
| (branched decyl DMAO 33%) | | |

TABLE 3

| 98.0 Milliliters of 1% Solution in Brine + 2.0 Milliliters of Kerosene | Foam Height in Millimeters | Half-Life in Seconds |
|---|---|---|
| n-hexyl DMAO | 0 | 0 |
| n-octyl DMAO | 90 | 161 |
| n-decyl DMAO | 75 | 168 |
| n-dodecyl DMAO | 20 | 20 |
| n-tridecyl DMAO | 23 | 20 |
| n-octyl DMAO 50% | 97 | 214 |
| n-decyl DMAO 50% | | |
| branched decyl DMAO | 58 | 188 |
| (branched decyl DMAO 50%) | 55 | 155 |
| (n-octyl DMAO 50%) | | |
| (branched decyl DMAO 50%) | 80 | 206 |
| (n-decyl DMAO 50%) | | |
| (n-octyl DMAO 33%) | 90 | 207 |
| (n-decyl DMAO 33%) | | |
| (branched decycl DMAO 33%) | | |

Tables 2 and 3, which permit a comparison of the foaming properties of the amine oxides in the presence of a relatively high concentration of hydrocarbons as well as soluble inorganic matter, show that n-octyl dimethylamine oxide, n-decyl dimethylamine oxide, branched decyl dimethylamine oxide and mixtures of these compounds, have superior foaming properties which are not attenuated by relatively large quantities of hydrocarbons.

The invention claimed is:

1. A foaming agent suitable for use in drilling for oil or gas comprising a branched decyl dimethylamine oxide the branched decyl group being derived from a mixture of branched primary alcohols having 10 carbon atoms, the major components of which are trimethyl heptanols.

2. A process of drilling for oil or gas in a field containing formation liquids and either brine, hydrocarbons or both brine and hydrocarbons, said process comprising the steps of drilling a bore into the field, inserting a foaming agent into said bore, and agitating said foaming agent and whatever formation liquids are in said bore to form a foam, said foaming agent being selected from the group consisting of n-octyl dimethylamine oxide, n-decyl dimethylamine oxide, branched decyl dimethylamine oxide and selected mixtures thereof.

3. The process of claim 2 wherein said branched decyl dimethylamine oxide is a derivative of a mixture of branched primary alcohols having 10 carbon atoms, the major components of which are trimethyl heptanols.

* * * * *